US005597077A

United States Patent [19]

Hartmann

[11] Patent Number: 5,597,077

[45] Date of Patent: Jan. 28, 1997

[54] VENTILATED SHELF LINERS AND ATTACHMENT MEANS THEREFOR

[76] Inventor: Matthew G. Hartmann, 920 Big Bend Station Dr., St. Louis, Mo. 63088

[21] Appl. No.: 444,265

[22] Filed: May 18, 1995

[51] Int. Cl.[6] ..... A47F 3/14

[52] U.S. Cl. ..... 211/134; 211/153; 211/181; 211/183

[58] Field of Search ..... 211/134, 90, 106, 211/153, 181

[56] References Cited

U.S. PATENT DOCUMENTS 4,890,746 1/1990 Trulaske, Sr. ..... 211/153 X 5,228,581 7/1993 Palladino et al. ..... 211/153

5,538,147 7/1996 Fucci ..... 211/153

*Primary Examiner*—Ramon O. Ramirez

*Assistant Examiner*—Michael J. Turgeon

*Attorney, Agent, or Firm*—Norman L. Wilson, Jr.

[57] ABSTRACT

The combination, a wire shelf, a shelf liner therefor, and a two element shelf liner retaining mechanism is disclosed. The wire shelf is the type including transverse deck rods supported by longitudinal rods. The shelf liner is in the form of a sheet of a plastic sized to rest on the transverse rods and to extend along the longitudinal rods. The two element liner retaining element includes a spring clip to hold the liner, and an integral rod engaging element to prevent the shelf liner from sliding.

3 Claims, 1 Drawing Sheet

VENTILATED SHELF LINERS AND ATTACHMENT MEANS THEREFOR

FIELD OF THE INVENTION

This invention relates generally to wire or ventilated shelf assemblies. More particularly the invention pertains to liners for such shelving, and to liner attachment apparatus.

BACKGROUND OF THE INVENTION

As disclosed in U.S. Pat. No. 5,346,077 wire shelving systems are well known and they are becoming increasingly popular. In the past, use of wire, or ventilated, shelves has been limited to industrial or commercial applications, such as in large refrigeration units, stock rooms and warehouses. The advantage of wire shelves was that they allowed circulating air to reach the goods stacked on those shelves.

Recently, wire shelving has come into wide use in homes. As pointed out in U.S. Pat. No. 4,781,349 ventilated rod-type shelving is now being used more widely because it is aesthetically pleasing. It is also desired because it is simple to assemble, even by relatively unskilled homeowners.

Wire shelving of the type contemplated herein generally encompasses a plurality of shelves, each of which includes a number of spaced apart, parallel, transverse deck rods which are supported by longitudinal rods which extend at least along the rearward and forward edges of each of the deck rods. Additional longitudinal rods can be provided across all of the transverse deck rods. Each of the shelves so constructed is mounted on a vertical support structure such as a closet or pantry wall by means of brackets, braces, and the like. Wire shelves are also the subject of other prior art patents, for instance, U.S. Pat. No. 3,367,510, as well as U.S. Pat. No. 5,148,928. And they are specifically described in U.S. Pat. No. 4,316,593.

Increased usage of shelves of the type described in these patents has revealed that they are subject to certain drawbacks. One such disadvantage is that when small electric appliances with legs, such as skillets and waffle irons are placed on the shelves, their legs penetrate the spaces between deck rods. Ultimately they can spread the rods apart. Electric cords used with such appliances also present a problem when it is desired to place them on ventilated or wire pantry shelving. Thus although wire shelves are desirable from the aesthetic and ease of installation points of view there are various end uses which are subject to improvement. The placement of small objects on such shelves can also be a problem, particularly on pantry and bathroom shelves. As an example, on pantry shelves small containers such as spice cans and bottles tend to tilt or fall over. On bathroom shelves care must be exercised if small medicine bottles and pill boxes are to be used, even when transverse rods are spaced one-half inch apart. In closet shelves, with one inch spacing of transverse rods, the heals of ladies shoes tend to drop between transverse rods. In the case of ventilated shelving in storage rooms, tools and the like will hang through, or fall through, the spaces between transverse rods. To overcome such spacing problems a few homeowners have resorted to the placement plywood panels or corrugated box panels on the shelves. Use of these panels, while covering the spaces between rods, defeats part of the reason for the shelves by destroying the aesthetic character of the shelf. It also works against the ease of installation of the shelving, especially if the plywood is being painted, to say nothing of the added weight. Such problems are eliminated by the liner of this invention, and, equally important, the aesthetic values of wire shelving are retained.

SUMMARY OF THE INVENTION

It has been realized that a clear plastic panel would permit retention of the aesthetic values of wire shelving, and hence constitute excellent wire shelf liners. This is especially true if thin, practically invisible, plastic shelf liners are employed. It has been found, however, that such liners do not stay in place, especially since wire shelves do not have lips or upwardly extending forward edges to hold them in place. To this end the invention herein includes a combination of a wire shelf, a shelf liner therefor, and a two element liner retaining mechanism. The wire shelf is a shelf of the type including a plurality of spaced apart transverse coated deck rods which are supported by longitudinal rods attached to the rearward and forward edges of the deck rods with an intermediate longitudinal rod attached to the underside of the transverse rods therebetween. The longitudinal and transverse deck rod combination forms a shelf with the lengths of the transverse deck rods defining the depth of the shelf and the lengths of the longitudinal rods defining the shelf length. The shelf liner includes a panel in the form of a sheet of a plastic having an impact strength sufficiently high to resist breaking by impact during placement of metal and glass objects on the shelf. The panel is sized to rest on the transverse rods and to extend across longitudinal rods. The two element liner retaining element includes as its first element two flat tong members oppositely disposed and joined at one end to form a U-shaped bifurcated spring clip which is adapted to grasp the edge of the liner panel. Its second element, which is integral with the spring clip, is a rod engaging element. This element is adapted to engage a longitudinal rod to prevent the shelf liner from sliding along the shelf.

The Invention

This invention can, perhaps, best be understood by reference to various figures of a drawing.

DETAILED DESCRIPTION OF THE INVENTION

Figure 1:
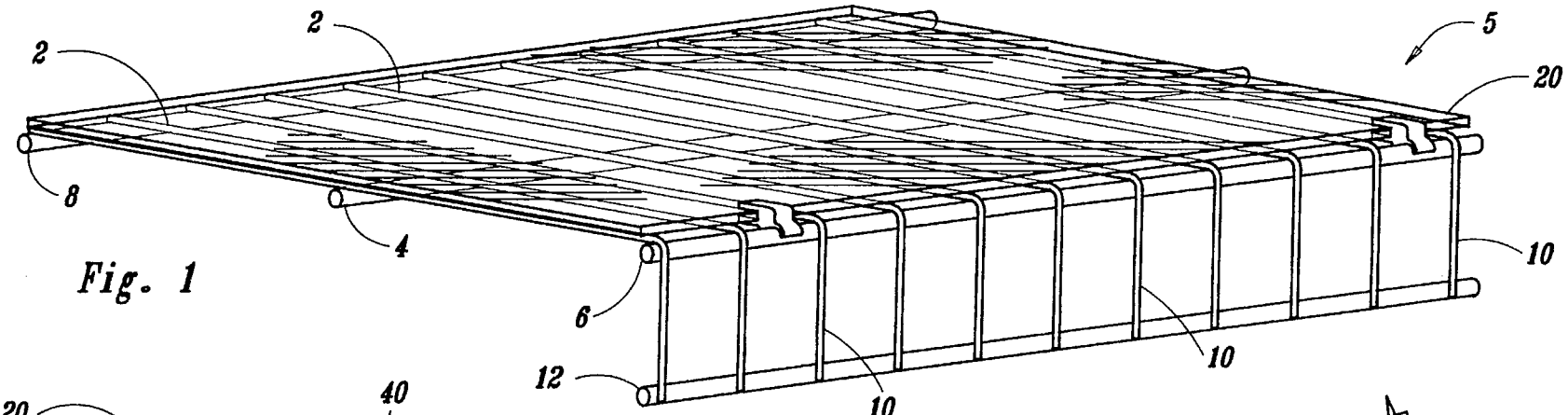
FIG. 1 a perspective view of a ventilated rod-type shelf showing a clear plastic liner resting thereon.

For an even better understanding of the invention it will be helpful first to describe the shelving to which the invention pertains. Since the liner 20 illustrated in FIG. 1 is clear plastic, the ventilated or wire shelving is visible. The contemplated shelving 5 is essentially in the form of a plurality of parallel transverse rods 2 which are welded or otherwise bonded to middle and end supporting longitudinal rods 4, 6, and 8. Such shelves also generally include a vertical downwardly-extending forward edge formed by parallel rods 10 which are essentially downwardly directed extensions of rods 2. Usually they are welded or otherwise attached to front longitudinal rod 12.

After being fabricated as shown the shelving 5 is generally coated with a flexible vinyl or epoxy resin, which generally contains a white pigment. This completes the shelf assembly. These shelves are sold with or without suitable brackets for installing them on walls of closets, pantries, or other desired rooms.

Figure 2:
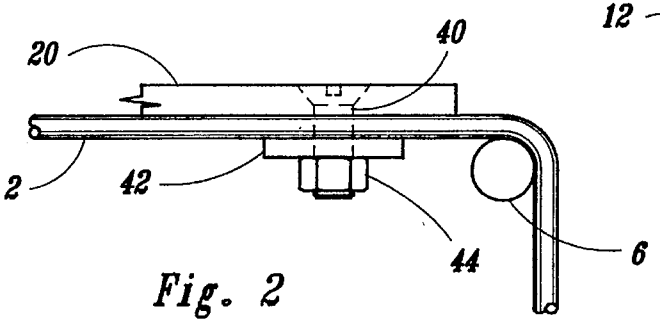
FIG. 2 is a view showing a bolt and plate plastic liner attachment means.

It has been pointed out that to overcome problems resulting from spaces between transverse rods, users of ventilated shelves have resorted to the placement plywood sheets and corrugated box panels on the shelves. This solution is subject to several disadvantages. First, those so doing usually discover that they must improvise some means to prevent the panel or liner from moving or sliding out of place. One means which might possibly be utilized with wood or plastic liners is illustrated in FIG. 2. This means would involve using a bolt 40 passing downwardly through the liner 20, and into a space between two transverse rods 2. In conjunction with the bolt, a plate 42 would overlap two transverse rods. Nut 44 would then draw plate 42 against the tops of the transverse rods to keep the liner 20 from sliding.

It will be appreciated that since ventilated shelving is popular because of its desired aesthetic qualities, the use of bolts and plates along its length is a definite detraction. Clear plastic liners revealing the wire structure are preferred. In addition, it is to be realized that bolt holes must be so spaced that they are not over a rod. The transverse rods would keep the panel liner away from the shelf and also prohibit placing a nut on that bolt. The placing of bolt holes, then, presents an additional problem for users of clear plastic ventilated shelf liners. Not only must the holes be drilled, but the fact that there are two meshes, or transverse rod spacings, must be taken into consideration. Further, from an aesthetic point of view the bolts and plates should be in some sort of alignment, both transversely and longitudinally.

More important, it will be desired periodically to clean the plastic shelf liner. The cleaning of liners which are bolted on, calls for the removal of the bolts. As will be explained, the use of the combination shelf liner and liner retaining means provided herein permits the liner to be partially rotated for ready cleaning.

A PREFERRED AND OTHER EMBODIMENTS OF THE INVENTION

As indicated previously the shelf liner of this invention prevents small objects from tipping, falling through, or protruding into spaces between transverse rods in wire shelving of the type illustrated in FIG. 1.

A preferred liner of this invention, also shown in FIG. 1, is in the form of a clear plastic panel 20 having an impact strength which will withstand the use to which such shelves are usually subjected, generally 100 in/lb or greater. Panels having a glass-like transparency are preferred in order to preserve the aesthetics of the wire shelves. Suitable plastics are thermoplastics having melting points above 140°, examples being polyethylene, modified polyethylene oxides, polystyrene extruded sheets, styrene-acrylonitrile copolymers, polyvinyl chloride, chlorinated polyvinyl chloride, vinylidene fluoride polymers, acrylonitrile butadiene styrene copolymers, high abrasion polyurethanes, and polycarbonates.

Thermoset resins are also suitable, especially where room temperatures may be higher than normal. Examples are thermoset polyesters, some of the silicones, and also the phenolics. Advanced plastics such as polyphthalamides, polysulphones, polyisocyanates, and polyisocyanurates, although more expensive, are not excluded.

Figure 3:
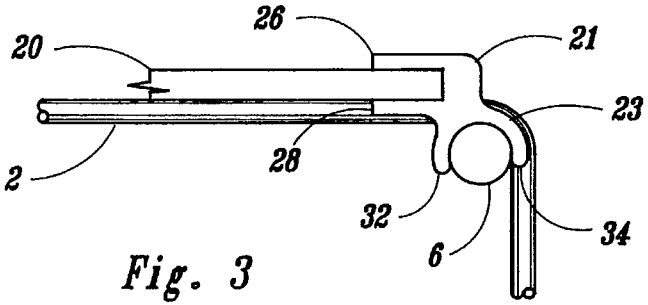
FIG. 3 is a left side view, partially broken away, showing a preferred plastic liner attachment means.

It has been emphasized that the combination herein includes not only a plastic shelf liner, but a two element liner retaining mechanism for securing the liner to the shelf to prevent it from sliding. Such two element retaining mechanisms are shown in the drawings, A preferred liner retaining mechanism is illustrated in FIG. 3. The two elements shown in that figure are a panel engaging spring clip, and a rod engaging collar grip which is integral with, or a part of the spring clip unit.

The panel engaging spring clip, shown in FIG. 3, is in the form of a bifurcated retainer in the form of two flat tong members 26 and 28. They are oppositely disposed and joined at one end 21 to form a U-shaped spring clip. The distance between tong members 26 and 28 is approximately equal to the thickness of the panel 20 so that the clip fits slidably but tightly to grasp the edge of the panel. Desirably the tongs will be closer to each other so that they must be spread apart in order to clamp on the panel on insertion. The lengths of tong members 26 and 28 are such that they do not permit the panel to slide out of them should the panel slide at an angle which would tend to spread the tong members apart.

Figure 4:
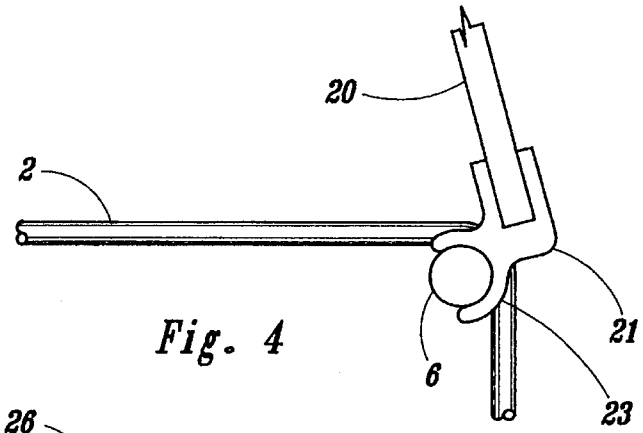
FIG. 4 is an end view similar to FIG. 3, but showing the plastic panel in position for cleaning.

The second element of the two element liner retaining mechanism, is a collar grip 23. In this preferred embodiment the collar grip is in the form of a resilient C-shaped clip adapted to snap over forward longitudinal rod 6. Collar grip 23 is not only integral with spring clip 21, but it is sufficiently resilient so that on being pressed against forward longitudinal shelf rod 6 its end clamping members 32 and 34 momentarily spread apart to grasp the longitudinal rod. It is clear from FIG. 3 that once snapped over longitudinal rod 6, collar grip 23 remains firmly in place. It not only prevents shelf liner 20 from sliding along shelf 5, but it grasps the rod so securely that it functions as a hinge, allowing panel 20 to be raised or partially rotated about this hinge for cleaning. This feature, readily discernible by referring to FIG. 4, is an important aspect of this invention. The figure shows that the collar grips and the spring clips hold the plastic panel so tightly its back end can be raised to a cleaning position as though it was a horizontal door.

Figure 5:
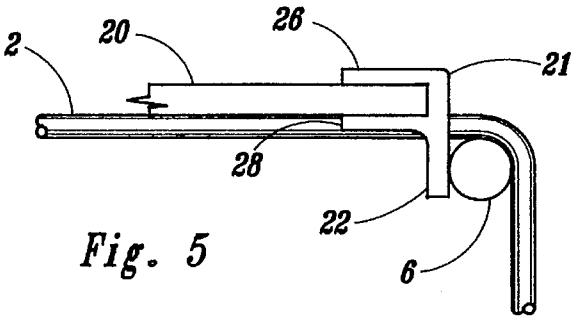
FIG. 5 is an end view similar to FIG. 3, but showing a different panel attachment means.

A different embodiment of the two element retaining mechanism is shown in FIG. 5. In this embodiment the rod engaging element is a tab 22. As in the retaining device of FIG. 3, this tab is integral with the spring clip. The tab is disposed approximately perpendicular to the opening between the tongs of the spring clip into which the liner panel slips. The tab thus extends downwardly as shown in FIG. 5 to abut the forward longitudinal rod 6 of the shelf. This prevents the liner from sliding forward or sideways along the shelf.

It can be seen that the combination of this invention is not only desirable for aesthetic effects, but also for rendering it possible to place small objects, appliances with legs, woman's shoes and the like, on ventilated wire shelving. The shelves, and brackets therefor, are, in themselves, known in the art. They are, nevertheless, components of the combination, of this invention. With this in mind, and in the light of the teachings herein of the invention, variations and ramifications will occur to those skilled in the art. Thus, although clear plastic panels are preferred as shelf liners to preserve the original desirable appearance of ventilated shelving, colored panels can be employed if it is desired to match other features of the room such as walls. Desirably these can be transparent colored panels, although opaque colored plastic panel liners are not excluded. In addition a liner panel can occupy the full width of a shelf. Thus, in the case of six-foot shelves, two three-foot panel sections can be employed. And in lieu of, say, an eight foot plastic liner panel, two four foot panels can be utilized as shelf liners. Indeed, if it is desired to cover only a portion of the shelf, fewer panel sections can be employed. Even a series of two-foot panels can be employed.

As a further embodiment, it may be desirable to snap collar grip 23 over the back longitudinal rod 8 rather than front rod 6. The front end of the plastic liner can then be raised during cleaning. Further, it has been emphasized that a thin, practically invisible, panel liner is desirable. These thinner panels are not only aesthetically better, but they are useful because they can be sized by cutting with scissors. Of course, thicker liner panels up to one-fourth inch thick can also be used. In addition wire shelf liner clips may be modified into forms other than the two types illustrated, the essence being the provision of a two element liner retaining mechanism which grasps the liner panel, and engages the longitudinal rod to prevent the shelf liner from sliding. It is understood, too, that whereas closet, bathroom and pantry shelves have been discussed, such shelves are used elsewhere, such as in basements and garages. Such modifications are, therefore, deemed to be within the scope of this invention.

What is claimed is:

1. In combination, a wire shelf, a shelf liner therefor, and a two element shelf liner retaining mechanism wherein the wire shelf is a shelf of the type including a plurality of spaced apart transverse deck rods having rearward and forward edges, the deck rods being supported by longitudinal rods attached to the rearward and forward edges of the deck rods with an intermediate longitudinal rod attached to the underside of the transverse rods therebetween so that the longitudinal and deck rod combination forms a shelf with the lengths of the transverse deck rods defining a depth of the shelf and the lengths of the longitudinal rods defining a shelf length, wherein the shelf liner includes a panel in the form of a sheet of a plastic having an impact strength sufficiently high to resist breaking by impact during placement of metal and glass objects thereon; wherein the shelf liner is sized to rest on the transverse rods and to extend lengthwise along the longitudinal rods, and wherein the two element liner retaining mechanism includes as a first element, two flat tong members oppositely, vertically disposed and joined at one end to form a U-shaped bifurcated spring clip, and as a second element integral with the spring clip, a rod engaging element adapted to engage the forward longitudinal rod to prevent the shelf liner from sliding, the distance between the tong members being approximately equal to the thickness of the panel so that the tong members grasp the edge of the panel, and the lengths of the tong members being such that they do not permit the panel to slide out of the tong members should the panel slide at an angle tending to spread the tong members apart, the forward longitudinal rod engaging element being a tab adapted to extend downwardly from the tong members and between transverse rods to abut the forward longitudinal rod of the shelf.

2. In combination, a wire shelf, a shelf liner therefor, and a two element shelf liner retaining mechanism wherein the wire shelf is a shelf of the type including a plurality of spaced apart transverse deck rods having rearward and forward edges, the deck rods being supported by longitudinal rods attached to the rearward and forward edges of the deck rods so that the longitudinal and deck rod combination forms a shelf with the lengths of the transverse deck rods defining a depth of the shelf and the lengths of the longitudinal rods defining a shelf length, wherein the shelf liner includes a panel in the form of a sheet of a plastic having an impact strength sufficiently high to resist breaking by impact during placement of metal and glass objects thereon; wherein the shelf liner is sized to rest on the transverse rods with edges extending lengthwise along the longitudinal rods, and wherein the two element liner retaining mechanism includes, as a first element, two flat tong members oppositely, vertically disposed and joined at one end to form a U-shaped bifurcated spring clip adapted to grasp an edge of the panel, the distance between the tong members being approximately equal to the thickness of the panel so that the tong members can grasp the edge of the panel, and the lengths of the tong members being such that they do not permit the panel to slide out of the tong members should the panel slide at an angle tending to spread the tong members apart, and as a second element, integral with the spring clip, a longitudinal rod engaging element adapted to engage the longitudinal rod, the rod engaging element comprising a collar grip in the form of a C-shaped clip adapted to fit on the longitudinal rod between the transverse rods, the clip being sufficiently resilient so that on being pressed against the longitudinal shelf rod the clip momentarily spreads apart and grasps the longitudinal rod so that the collar grip functions as a hinge holding the plastic panel, so that the panel can be pivotally raised about this hinge to a cleaning position.

3. A retainer for a liner for a wire shelf of the type including a plurality of spaced apart transverse deck rods having rearward and forward edges, the deck rods being supported by longitudinal rods attached to the rearward and forward edges of the deck rods, the retainer being in the form of a two element shelf liner retainer adapted to fit on the longitudinal between the transverse deck rods of the shelving, the first element being two flat tong members oppositely vertically disposed and joined at one end to form a U-shaped bifurcated spring clip adapted to hold a shelf liner, and a second element, integral with the spring clip, being a collar grip in the form of a C-shaped clip sufficiently resilient so that on being pressed against the longitudinal shelf rod, the clip momentarily spreads apart and grasps the longitudinal rod so that the clip functions as a hinge holding the liner so that it can be raised about that hinge for cleaning.

* * * * *